US011097289B2

(12) United States Patent
Kajuch et al.

(10) Patent No.: US 11,097,289 B2
(45) Date of Patent: Aug. 24, 2021

(54) SPRAYER

(71) Applicant: Kohler Co., Kohler, WI (US)

(72) Inventors: Pete Kajuch, Brookfield, WI (US); Meghamukta Ghosh, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 302 days.

(21) Appl. No.: 16/390,332

(22) Filed: Apr. 22, 2019

(65) Prior Publication Data

US 2019/0321836 A1 Oct. 24, 2019

Related U.S. Application Data

(60) Provisional application No. 62/661,282, filed on Apr. 23, 2018.

(51) Int. Cl.
*B05B 1/18* (2006.01)
*B05B 12/16* (2018.01)

(52) U.S. Cl.
CPC ..... *B05B 1/185* (2013.01); *B05B 12/16* (2018.02)

(58) Field of Classification Search
CPC .. B05B 1/02; B05B 1/18; B05B 1/185; B05B 1/26; B05B 12/16
See application file for complete search history.

(56) References Cited

U.S. PATENT DOCUMENTS 3,776,469 A 12/1973 Joannon
4,618,100 A 10/1986 White et al.
5,102,048 A 4/1992 Bohnhoff
5,172,862 A * 12/1992 Heimann ..... B05B 15/528 239/114
5,647,537 A 7/1997 Bergmann
6,463,658 B1 * 10/2002 Larsson ..... B05B 1/185 29/890.142
6,554,212 B2 4/2003 Borcea et al.
6,719,218 B2 4/2004 Cool et al.
(Continued)

FOREIGN PATENT DOCUMENTS

WO WO 2016/162048 4/1992
WO WO 2016/091398 6/2016

OTHER PUBLICATIONS http://thesweethome.com/reviews/the-best-shower-head/; dated Oct. 27, 2016.

(Continued)

*Primary Examiner* — Darren W Gorman
(74) *Attorney, Agent, or Firm* — Foley & Lardner LLP

(57) ABSTRACT

A sprayer having a spray head configured to receive water; a spray face coupled to the spray head and defining an internal fluid chamber, which is located between the spray face and the spray head and is fluidly connected with the spray head, wherein the spray face includes a plurality of channels and a plurality of apertures; a control ring having a plurality of channels, wherein the control ring is coupled to the spray face so that each channel of the control ring cooperates with one associated channel and one associated aperture of the spray face to define a nozzle cavity; and a nozzle assembly having a mat and a plurality of nozzles coupled to the mat, wherein each nozzle of the plurality of nozzles is disposed in one associated nozzle cavity to control an orientation of the nozzle.

20 Claims, 8 Drawing Sheets

(56) References Cited

U.S. PATENT DOCUMENTS

| | | | | |
|---|---|---|---|---|
| 6,735,883 | B1 | 5/2004 | Bria et al. | |
| 6,776,357 | B1 | 8/2004 | Naito | |
| 6,795,981 | B2 | 9/2004 | Sato et al. | |
| 7,111,798 | B2 | 9/2006 | Thomas et al. | |
| 7,770,820 | B2 * | 8/2010 | Clearman | B05B 3/16 239/222.11 |
| 7,854,401 | B2 | 12/2010 | Malek | |
| 7,878,419 | B2 | 2/2011 | Waddelow | |
| 8,292,200 | B2 | 10/2012 | Macan et al. | |
| 8,733,675 | B2 | 5/2014 | Leber | |
| 9,623,423 | B2 * | 4/2017 | Erickson | B05B 1/14 |
| 9,630,192 | B2 | 4/2017 | Kusu | |
| 2011/0174894 | A1 | 7/2011 | Miller et al. | |
| 2014/0138461 | A1 | 5/2014 | Kajuch | |
| 2016/0325292 | A1 | 11/2016 | Hawkins | |
| 2017/0173601 | A1 * | 6/2017 | Mazz | B05B 1/16 |
| 2018/0078953 | A1 * | 3/2018 | Renner | B05B 1/18 |
| 2018/0161787 | A1 * | 6/2018 | Gao | E03C 1/0405 |

OTHER PUBLICATIONS

Chinese Office Action CN Application No. 201910328692.5 dated Nov. 2, 2020 6 pages.

* cited by examiner

SPRAYER

CROSS-REFERENCE TO RELATED PATENT APPLICATIONS

This application claims priority to and the benefit of U.S. Provisional Patent Application No. 62/661,282, filed Apr. 23, 2018. The entire disclosure of the foregoing application is incorporated herein by reference in its entirety.

BACKGROUND

The present invention relates generally to the field of sprayers for showerheads, faucets, and the like that direct streams of water that form one or more spray patterns. More specifically, this application relates to sprayers designed to emit higher accuracy converging streams of water.

SUMMARY

One embodiment of this application relates to a sprayer that includes a spray head, a spray face, a control ring, and a nozzle assembly. The spray head is configured to receive water. The spray face is coupled to the spray head so that an internal fluid chamber is located between the spray face and the spray head and the internal fluid chamber is configured to receive water from the spray head. The spray face includes a plurality of channels and a plurality of apertures. The control ring includes a plurality of channels, and the control ring is coupled to the spray face so that each channel of the control ring cooperates with one associated channel of the spray face and one associated aperture to define a nozzle cavity. The nozzle assembly includes a mat and a plurality of nozzles coupled to the mat, where each nozzle is disposed in one associated nozzle cavity to control an orientation of the nozzle.

At least one embodiment relates to a sprayer that includes a spray head, a spray face, an annular control ring, and a nozzle assembly. The spray head has a base, a wall extending from the base, and a water inlet. The spray face is coupled to the spray head forming an internal fluid chamber, which is located between the spray face and the spray head and is fluidly connected to water inlet. The spray face includes a plurality of channels and a plurality of apertures. The control ring is coupled to the spray face and includes a plurality of channels along an inner periphery, where each channel of the control ring cooperates with one associated channel of the spray face and one associated aperture to define a nozzle cavity. The nozzle assembly includes a flexible mat and a plurality of nozzles coupled to the mat, where each nozzle is disposed in one associated nozzle cavity having an assembled orientation relative to the mat.

At least one embodiment relates to a sprayer that includes a spray head having a base, a wall extending from the base, and a water inlet; and a spray face coupled to the spray head forming an internal chamber, which is between the spray face and the spray head and is fluidly connected to water inlet, where the spray face includes a plurality of channels and a plurality of apertures. The sprayer also includes a control ring that is coupled to the spray face and is disposed in the internal chamber, and the control ring includes a plurality of channels along an outer periphery, where each channel of the control ring cooperates with one associated channel of the spray face to define a nozzle cavity. The sprayer also includes a nozzle assembly that includes a flexible mat and a plurality of nozzles coupled to the mat, where the mat is disposed in the internal chamber, and each nozzle is disposed in one associated nozzle cavity.

DETAILED DESCRIPTION

Figure 1:
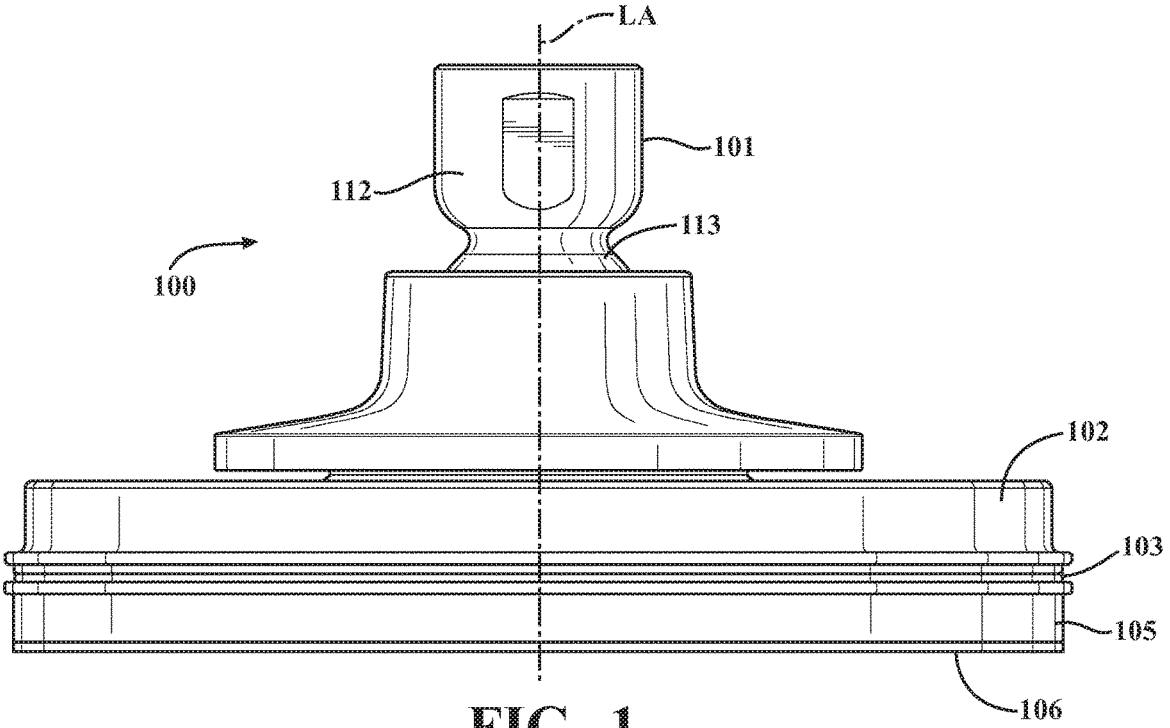
FIG. 1 is a side view of an exemplary embodiment of a sprayer, according to this application.

As water delivery devices have evolved, so have the sprays (e.g., spray patterns) emitted from the devices. The term "sprayer" is used herein to include all types of water delivery devices for kitchens, baths, and the like, including, but not limited to showerheads, shower tiles, ceiling tiles/showers, hand showers, kitchen spraying devices (e.g., faucets, side sprays, etc.), body spraying devices for toilets and bidets (e.g., bidet wands, injection members, etc.), lavatory faucets, and so forth. Water shapes from sprayers can be engineered based on numerous considerations, such as, for conservation, functionality, and performance, among others. In the case of showerheads, water conserving sprays may need to provide the same performance as other showerheads that consume more water (e.g., 25% more water). To achieve this, a spray pattern can be configured to include streams that converge to concentrate the water, such as to rinse shampoo and/or to provide intensity. In the case of kitchen faucets, sprays are often used to remove food from dishes. To do this, a spray can be configured to converge to increase the pressure (by concentrated force) and provide scrubbing or movement of food. An exemplary embodiment of such a sprayer can be found in U.S. Pat. No. 9,623,423 (issued Apr. 18, 2017 and assigned to Kohler Co.), the disclosure of which is incorporated by reference herein in its entirety. Converging sprays are difficult to control in manufactured sprayers, and also require accuracy of aim for the function and appearance. Errant water streams are easily visible and unsightly in converging sprays (as compared to diverging sprays), and provide the appearance of poor quality or malfunction. In a diverging spray, the external streams surround most of the internal streams and conceal them.

Referring generally to the Figures, disclosed herein are sprayers designed to emit higher accuracy converging streams of water. The sprayers are devised to provide high accuracy of directional aim for fluid jets utilizing lower cost and lower complexity manufacturing processes/methods. This controls the appearance of a converging pattern, the location of concentration, and the overall shape of the spray. Likewise, the sprayers disclosed herein provide the directional aim needed to arrange colliding streams and the resulting spray functions. The aspects of this application can also be used for diverging sprays or any general application to solve problems associated with molded undercuts that may be used in connection with sprayers or other similar applications. Severe undercuts can be formed by angular cores, but such cores require tooling mechanisms or separate hydraulic actuation. This can be costly but moreover is not feasible for an arrangement of closely spaced nozzles. One solution is to utilize a draft angle that is large enough to overcome the undercut, where the nozzle direction is based on a theoretical centerline of a cone that is angled with respect to the mold parting direction. However, the actual fluid jet direction often does not match closely with the theoretical/predicted direction, because the pipe length of the nozzle is not uniform or because other dynamics such as turbulence influence the fluid flow. The best fluid aim is achieved with a symmetric pipe and uniform velocity profile. Often, the (pipe/nozzle) angle is too large for open/shut molding of both rigid (e.g., semi-rigid, rigid) and flexible (e.g., elastomeric) materials. The sprayers of this application provide, among other things, orientation of a straight pipe such as at a compound angle beyond the limits of conventional molding and without machining parts.

FIGS. 1-6 illustrate an exemplary embodiment of a sprayer 100 that includes a base 101 that is mountable to a water supply, such as a water inlet line (e.g. for showerheads and the like), a spout (e.g. for faucets and the like), a water conduit (e.g., hoses and the like). The illustrated sprayer 100 also includes a spray head 102 coupled to and in fluid communication with the base 101, a spray face 103 coupled to the spray head 102 forming/defining an internal fluid chamber 104 therebetween, a control ring 105 coupled to an external part of the spray face 103, and a nozzle assembly 106 coupled to the control ring 105 and the spray face 103 so that the nozzle assembly 106 is fluidly connected with the fluid chamber 104 and provided on the outside of the sprayer 100. Water flows into the base 101 from the water supply and into the fluid chamber 104, then water flows through the nozzle assembly 106 into a spray pattern defined by the nozzle(s) in the nozzle assembly 106. For an exemplary embodiment of the inlet sprayer 100, the spray face 103, the control ring 105, and the nozzle assembly 106 are separately formed elements that are coupled together to form the sprayer 100. This arrangement advantageously allows for tighter control of the features defining each nozzle cavity, which in-turn provides tighter control of the spray emitted from the nozzles in the nozzles cavities. The spray head 102 can also be formed separately from or integrally with the base 101 and/or the spray face 103.

Figure 2:
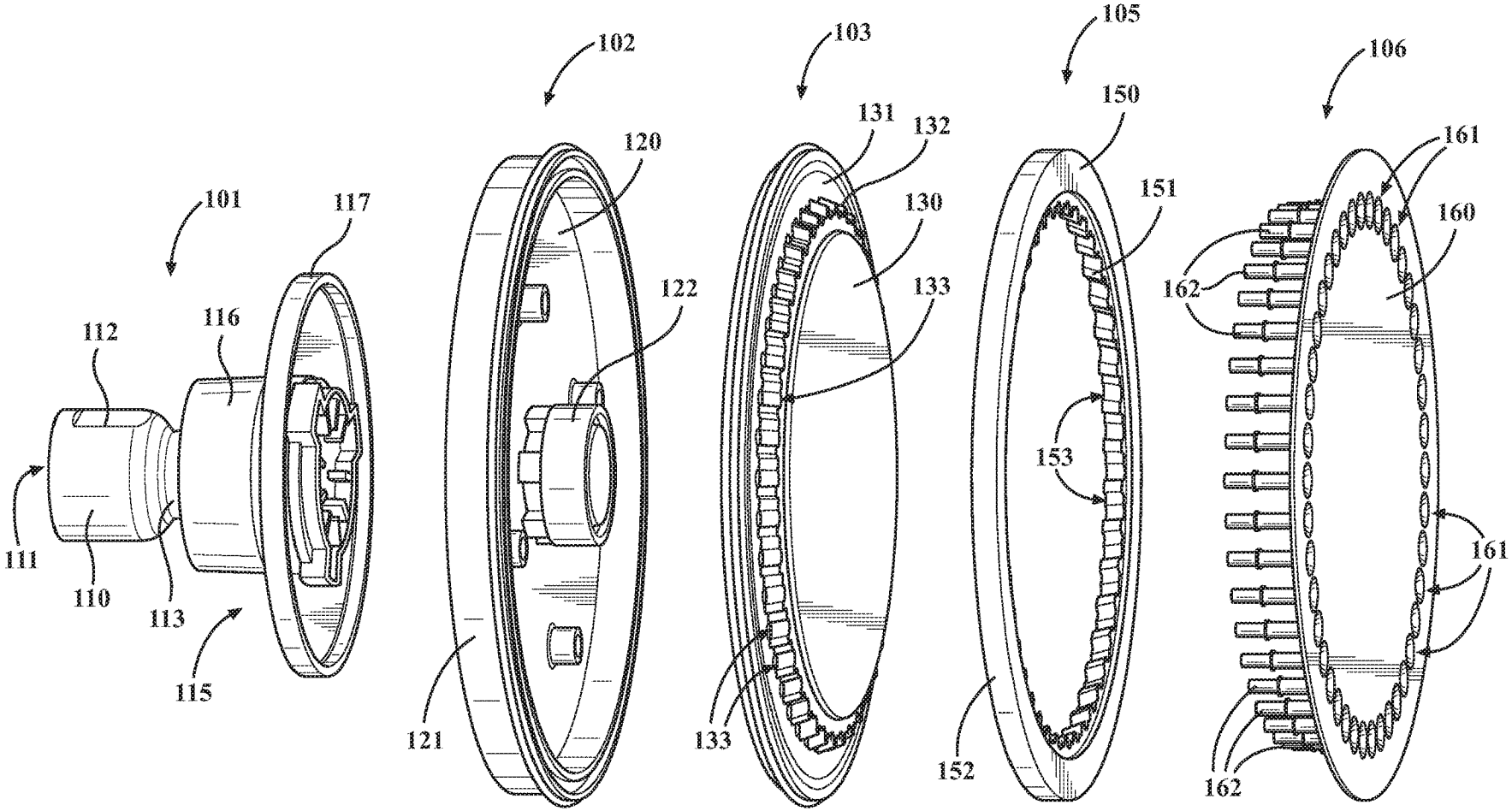
FIG. 2 is an exploded perspective view of the sprayer shown in FIG. 1.

As shown in FIGS. 1 and 2, the base 101 includes a joint connector 110 having an inlet 111 and an outlet that is fluidly connected to the inlet 111 through a fluid passage within the joint connector 110. The joint connector 110 includes an inlet portion 112, which if provided, facilitates coupling the inlet portion to a water supply, such as a water inlet line (not shown) through threads at the inlet 111 to fluidly connect the inlet 111 to the water inlet line. The joint connector 110 can include an outlet portion 113, which may have a ball (e.g., spherical member) to facilitate pivoting. The base 101 can include a mount 115 that is operatively coupled to the ball to provide free rotation of the mount 115 about the ball. The mount 115 includes a body 116 having a recess that receives the ball. A shouldered flange 117 extends from the body 116 opposite the inlet end. As shown in FIG. 2, the flange 117 has a larger diameter than the body 116 and is configured to couple to the spray head 102 such as through one or more fasteners. A fluid passage in the mount 115 fluidly connects the joint connector 110 and the spray head 102. It is noted that although the sprayer 100 is shown having a joint connector 110, the water inlet can be directly located at the spray head 102 thereby eliminating the joint connector/base, such as according to other embodiments. It is further noted that the illustrated base 101 is generally used for showerheads and the like, and that the base 101 can be configured differently to accommodate other types of sprayers.

Figure 3:
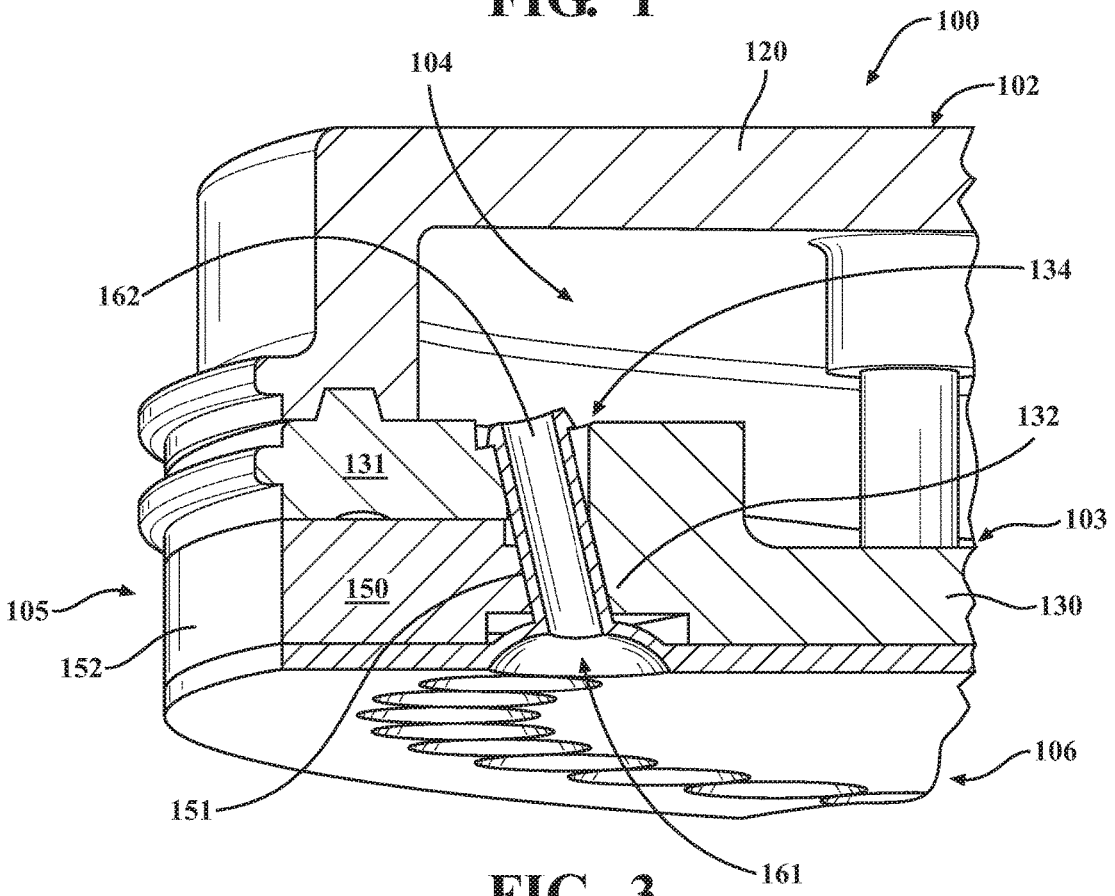
FIG. 3 is a cross-sectional view of part of the sprayer shown in FIG. 1.

As shown in FIGS. 2 and 3, the spray head 102 includes a circular base 120 coupled to the flange 117, an annular wall 121 extending away from the base 120 around the outer periphery of the base 120, and an inlet 122 (e.g., in the form of an annular inner wall defining a fluid passage) that is fluidly connected to the passage in the inlet portion 112 of the base 101. The base 120 and the wall 121 alone or in further combination with other elements of the spray head 102 (e.g., inlet 122) and/or other elements of the spray face 103 (e.g., inner surfaces) define the fluid chamber 104 with the spray face 103.

Figure 5:
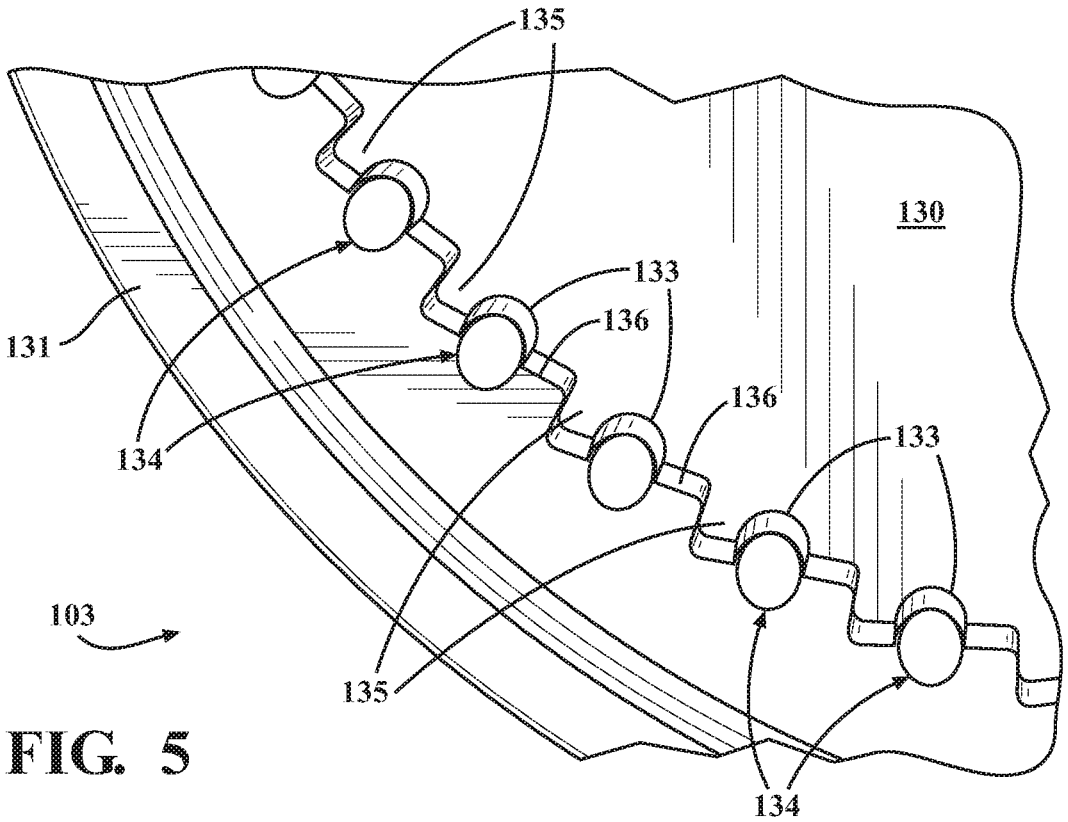
FIG. 5 is a perspective view of a portion of a spray face of the sprayer shown in FIG. 1.

Also shown in FIGS. 2 and 3, the spray face 103 has a circular center section 130 and an annular flange 131 extending around the periphery of the center section 130. The flange 131 is shown offset from the center section 130 in a direction toward the spray head 102 with a webbing 132 interconnecting the flange 131 and the center section 130. As shown in FIG. 2, the webbing 132 has an annular (e.g., ring) shape extending around the outer periphery of the center section 130 and around an inner periphery of the flange 131. As shown in FIGS. 2 and 5, the webbing 132 has a plurality of outer channels 133 that extend longitudinally (i.e., generally along the longitudinal axis LA shown in FIG. 1, although the channels can be at one or more oblique angles thereto) around the outer periphery of the webbing 132, and each outer channel 133 cooperates with an associated inner channel of the control ring 105, as discussed below. As shown in FIGS. 3 and 5, an aperture 134 (e.g., hole, opening, seal opening, etc.) is associated with each outer channel 133 such that they are generally aligned, as discussed below. Each aperture 134 forms an elliptical shaped opening by being aligned at an angle (e.g., oblique) relative to the inner/outer surface of the center section 130. This arrangement advantageously allows for spray face 103 to be manufactured using less expensive and complicated methods (e.g., open-shut molding). As shown in FIG. 3, each aperture 134 extends through the flange 131 to be in fluid communication with the fluid chamber 104 and is aligned with the associated outer channel 133 to form a bore (e.g., nozzle cavity, nozzle bore, etc.) for receiving one associated nozzle 162 of the nozzle assembly 106, as discussed below. Each pair of adjacent outer channels 133 is separated by a projection 135 (FIG. 5) extending longitudinally between the flange 131 and the webbing 132 and extending radially outward from an adjacent wall 136 of the webbing 132/center section 130 toward the flange 131. The plurality of projections 135 are akin to teeth that cooperate with features (e.g. notches) of the control ring 105 to define the nozzle cavities that receive the nozzles 162. Further, each adjacent projection 135 and wall 136 define a notch that receives a projection (tooth) of the control ring 105.

Figure 4:
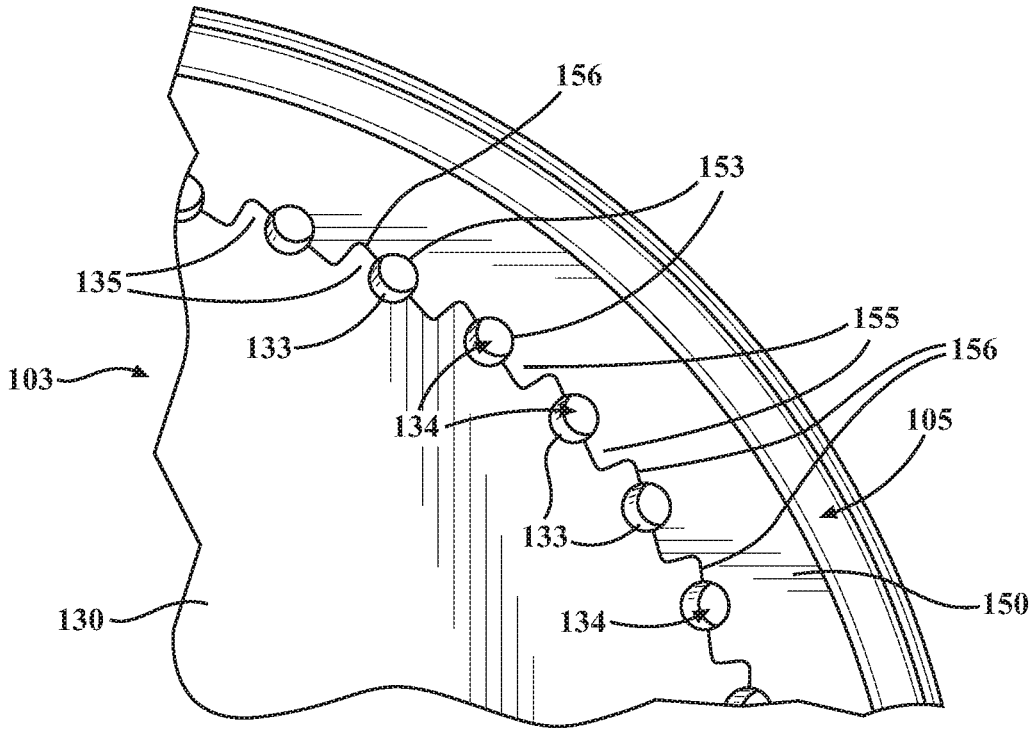
FIG. 4 is a perspective view of a portion of a control ring and a spray face of the sprayer shown in FIG. 1.

Also shown in FIGS. 2 and 3, the control ring 105 has an annular body 150 having an inner periphery 151 and an outer periphery 152, which is substantially aligned with a portion of the spray face 103. As shown in FIG. 4, the inner periphery 151 includes a plurality of inner channels 153 that extend longitudinally around the inner periphery 151. Each inner channel 153 cooperates with an associated outer channel 133 of the spray face 103. Each pair of adjacent inner channels 153 is separated by a projection 155 extending longitudinally between a first side adjacent to and facing the nozzle assembly 106 and a second side, which is opposite the first side, and extending radially inward from an adjacent wall 156 of the inner periphery 151. The plurality of projections 155 are akin to teeth that cooperate with the notches defined by the projections 135 and the walls 136 of the spray face 103 to couple the control ring 105 and spray face 103 together with the channels 133, 153 defining bores or nozzle cavities for receiving the nozzles 162. Each pair of associated projections 135, 155 is received in a mating notch of the other part to define one nozzle cavity. As shown in FIG. 3, the thickness of the control ring 105 is substantially the same as the offset from the center section 130 to the flange 131 so that when the control ring 105 is coupled to the spray face 103, the surfaces or sides of the control ring 105 and spray face 103 that are proximate to and facing the nozzle assembly 106 are substantially flush (e.g. coplanar).

Also shown in FIGS. 2 and 3, the nozzle assembly 106 includes a base 160 (e.g., webbing, mat, etc.), a plurality of openings 161 aligned circumferentially in the base 160, and a plurality of nozzles 162 extending from an inner side the base 160, where each nozzle 162 is associated with and aligned with one opening 161. The base 160 has an outer surface, which forms an aesthetic surface (i.e., is visible to a person using the sprayer), and an inner surface which is proximate to (e.g., abuts) the control ring 105 and/or the spray face 103. It is advantageous for the nozzle assembly 106 to be flexible (e.g., compliant) and, therefore, made from a flexible material, such as an elastomer or other suitable flexible material.

Figure 6:
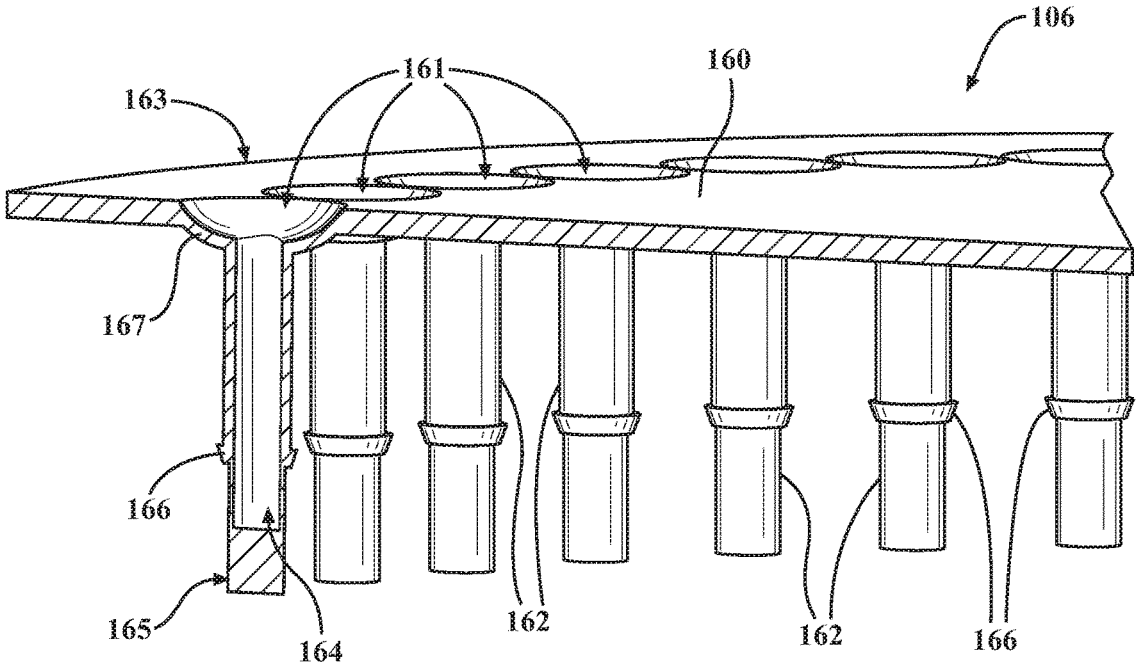
FIG. 6 is a perspective view of a portion of a nozzle assembly of the sprayer shown in FIG. 1.

According to one example, the nozzles 162 are integrated on a single elastomeric mat, which is attached to the spray face 103 and the control ring 105 to provide a cosmetic surface 163 that can be colored and/or styled as desired and according to the application (e.g. type of sprayer). According to the example shown in FIG. 6, the nozzles 162 are molded substantially perpendicular to the base 160 with passages 164 closed by tethers 165, which are smaller in diameter and can pass through a nozzle cavity (e.g., sealing hole) to facilitate assembly. Each nozzle 162 is tubular having a wall defining a fluid passage 164 therein. According to one example, each nozzle 162 is a substantially straight tube (i.e., having a substantially uniform size/diameter), which reduces cost and complexity of tooling (e.g., slides, lifters, etc. can be eliminated). The end of each nozzle 162 can include a solid tether 165 (e.g., as shown in FIG. 6), which if provided, is trimmed during the assembly process, as discussed below. The solid tether 165 advantageously eliminates the issue of flash build up, which is common to thru holes during molding the part. Each nozzle 162 includes a ring 166 (or semi-annular rib) that extends radially outward and around at least a portion of the nozzle 162 at a location that is proximate to the end of the nozzle 162 (after trimming as shown in FIG. 3). Also shown, the ring 166 acts as a detent to hold the nozzle 162 (and nozzle assembly 106) in place relative to the spray face 103 after assembly. As shown in FIG. 6, a concave shaped web 167 flexibly connects each nozzle 162 to the base 160 allowing the nozzle 162 to move/flex relative to the base 160. However, it is noted that the web 167 can be other shapes (e.g., conical, frusto-conical, semi-spherical, etc.) depending on the desired flexibility. It is advantageous for nozzles configured as straight tubes to have a threshold aspect ratio (i.e., a ratio of length to diameter) to develop a steady state velocity profile. According to one example, the desired aspect ratio is at least 3:1. However, according to another example, the desired aspect ratio is at least 6:1.

As shown in FIGS. 3 and 4, each aperture 134 of the spray face 103 cooperates with one outer channel 133 of the spray face 103 and one inner channel 153 of the control ring 105 to form one nozzle cavity that is configured to receive one nozzle 162 of the nozzle assembly 106. Each nozzle 162 passes through one aperture 134 in the spray face 103 and individually seals the aperture 134 of the associated nozzle cavity to prevent water leaking between the nozzle 162 and the spray face 103. During assembly, each tether 165 is pulled through the associated nozzle cavity and aperture 134, which stretches the nozzle 162. Once the ring 166 of the nozzle 162 is through the channels 133, 153 and the aperture 134 so that the nozzle assembly 106, control ring 105 and the spray face 103 are coupled together, the tether 165 is released and the elastomeric nozzle 162 snaps back to fit tightly within and seal the aperture 134 of the associated nozzle cavity from water leakage. The tether 165 is then trimmed (e.g., cut off) to open the nozzle 162 to fluid flow. Water passing through the nozzle 162 creates an internal pressure that acts to increase the size (e.g., diameter) of the pipe wall of the nozzle 162, which further improves sealing between the nozzle 162 and the spray face 103 (and control ring 105). The intersection of the nozzle 162 and the base 160 (mat) can be shaped to flex, which advantageously allows a compound trajectory of the water stream from the nozzle 162 without significant distortion.

Upon assembly of the sprayer 100, water enters the fluid chamber 104 through the fluid connection between the spray head 102 and the base 101, which then flows through the plurality of nozzles 162 to form a spray pattern having a plurality of fluid streams, with each fluid stream being emitted from one nozzle 162. The direction of each fluid stream is controlled by the orientation (e.g., alignment) of the associated nozzle 162, which in turn is controlled by the orientation of the associated nozzle cavity. As discussed, the orientation of each nozzle cavity is controlled by the cooperation of the spray face 103 and a control ring 105, which are divided along the compound axis of the desired spray trajectory of the fluid stream from the nozzle 162. Each portion of the compound passage of the nozzle cavity can be made with lower cost, conventional methods (e.g., molding), but when assembled together form an undercut passage. Aiming accuracy is influenced by directional control at the fluid exit and, thus, for a sprayer 100 having an external nozzle assembly 106 (e.g., which is a flexible mat), the control ring 105 is provided on the outer diameter and on the outside of the spray face 103.

Figure 7:
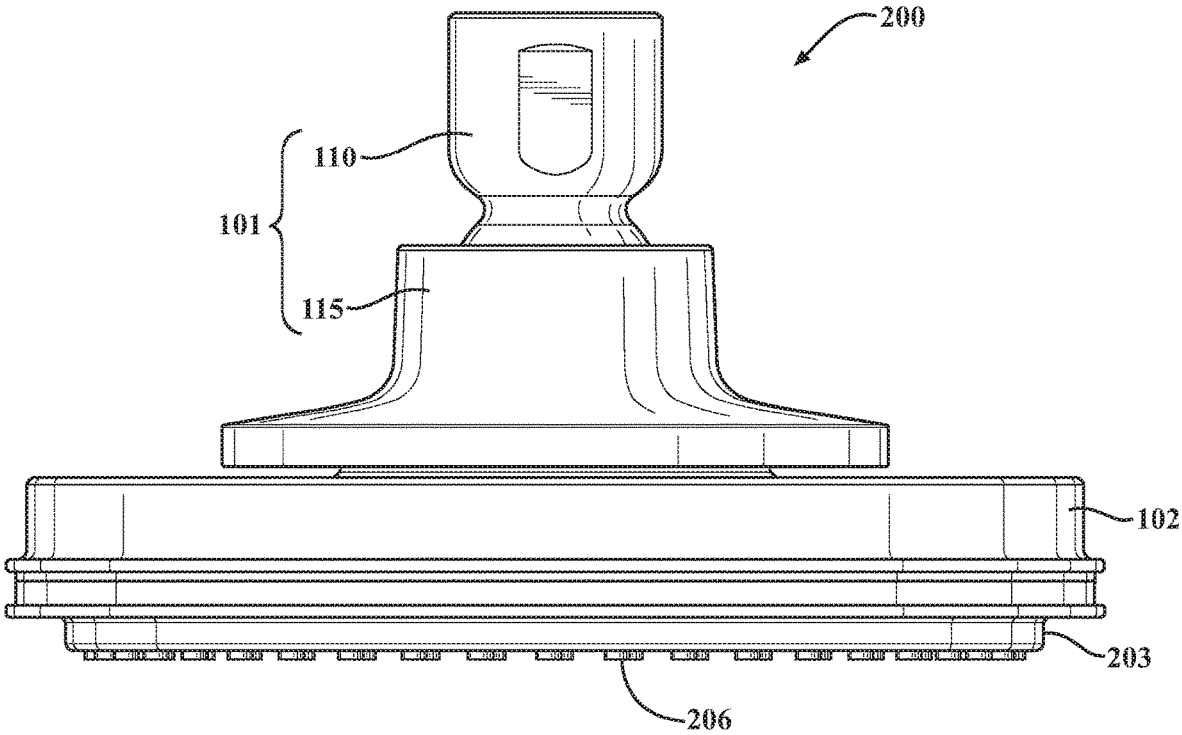
FIG. 7 is a side view of an exemplary embodiment of a sprayer, according to this application.
Figure 8:
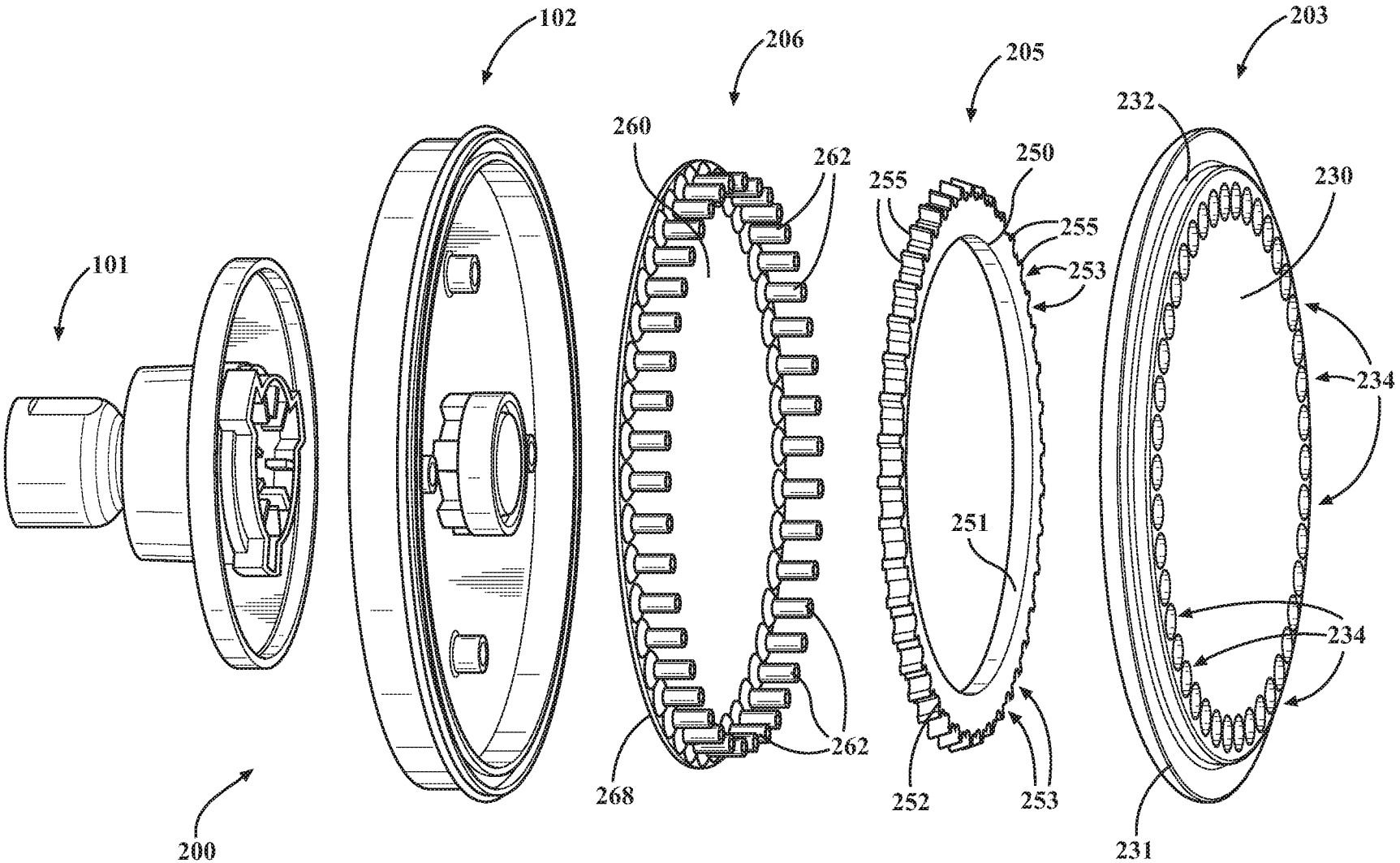
FIG. 8 is an exploded perspective view of the sprayer shown in FIG. 7.
Figure 9:
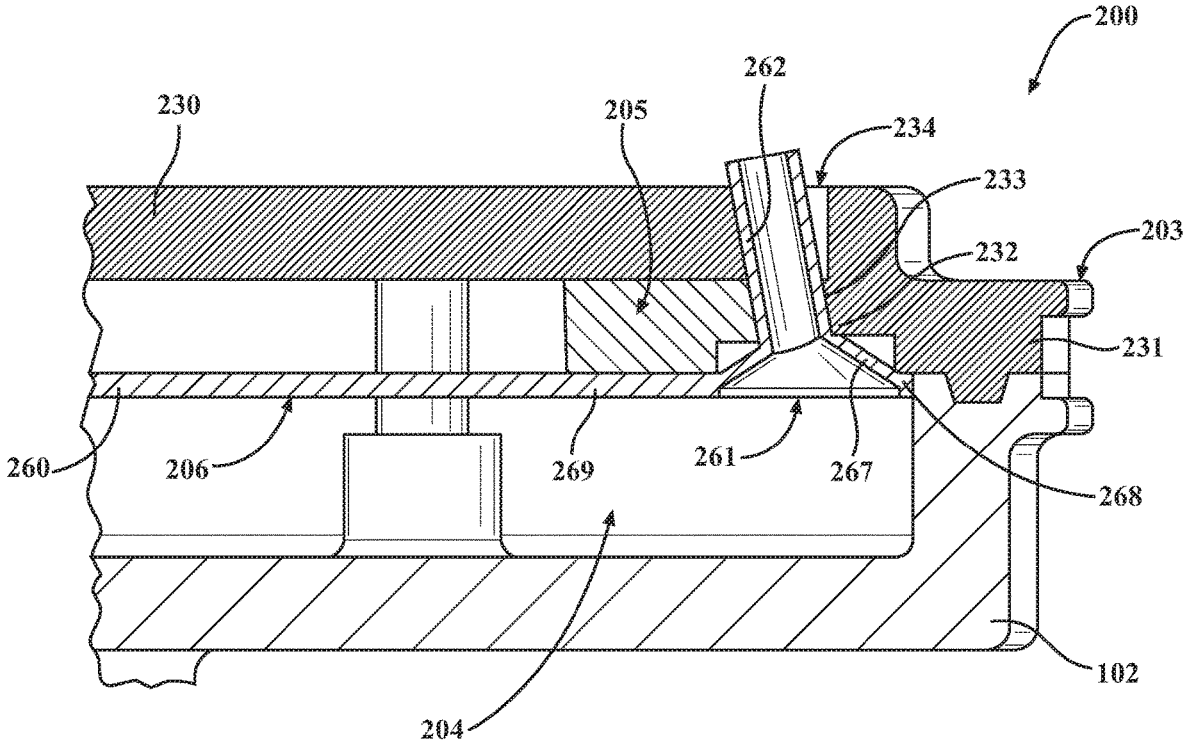
FIG. 9 is a cross-sectional view of part of the sprayer shown in FIG. 7.

FIGS. 7-9 illustrate an exemplary embodiment of a sprayer 200 that includes the swivel base 101 that is mountable to a water inlet line, although the base 101 can be configured to couple to other types of water supplies. The illustrated sprayer 200 also includes a spray head 102 coupled to and in fluid communication with the base 101, a spray face 203 coupled to the spray head 102 forming a fluid chamber 204 therebetween, a control ring 205 coupled to an internal part of the spray face 203, and a nozzle assembly 206 that is located between the spray face 203 and the spray head 102 and is coupled to the control ring 205 and the spray face 203 so that the nozzles 262 of the nozzle assembly 206 are fluidly connected with the fluid chamber 204. Water flows into the base 101 from a water supply and into the fluid chamber 204, then water flows through the nozzles 262 of the nozzle assembly 206 into a spray pattern defined by the nozzles 262 (e.g., their orientation). The base 101 is configured the same as that described above (for the sprayer 100) having a joint connector 110 and a mount 115 coupled thereto. Similarly, the spray head 102 is also configured the same as that described above.

The nozzle assembly 206 is configured similar to the nozzle assembly 106 described above and includes a base 260 (e.g., webbing, mat, etc.), a plurality of openings 261 aligned circumferentially in the base 260, a plurality of nozzles 262 extending from the base 260 with one nozzle 262 associated with and aligned with one opening 261, and with a web 267 connecting each nozzle 262 to the base 260. However, the nozzle assembly 206 differs (e.g. from the nozzle arm 106) in that the base 260 is disposed inside the fluid chamber 204 (rather than an external cosmetic face) and, accordingly, has several structural changes in view of this difference. One change is the distal end of each nozzle 262 is proximate to (or extends beyond) the outer surface of the spray face 203. Another change is the base 260 seals to the fluid chamber 204. As shown in FIG. 9, an outer periphery 268 of the base 260 forms a seal (e.g., first seal) with the spray head 102 (e.g., the wall 121) and the spray face 203. An inner part 269 of the base 260, which is located radially inward from the outer periphery 268, can be configured to form a seal, such as with the control ring 205 (e.g., an inner portion of the body). This arrangement (e.g., one seal) eliminates the need for each nozzle 262 to seal with the structure of the spray face 203 and the control ring 205 that for the nozzle cavity in which the nozzle 262 is disposed within. Additionally, this arrangement can optionally eliminate the tether (e.g., tether 165) and/or the ring (e.g., the ring 166) on each nozzle 262, as well as the trimming of each tether (which could present cosmetic challenges for this embodiment, such as if they were trimmed having different lengths). One advantage of this arrangement having the tubes of the nozzles 262 extend through the nozzle cavity from the inside to the outside (and optionally protrude beyond the outer surface of the spray face 203) is that cleaning the nozzles 262 is made easier, since recessed nozzles 262 typically are more difficult to clean since they can trap debris. Also shown, another change is the web 267 is frusto-conical shaped, although other shapes could be used.

As shown in FIGS. 8 and 9, the spray face 203 includes a circular center section 230 and an annular flange 231 extending around the periphery of the center section 230. The flange 231 is offset from the center section 230 in a direction toward the spray head 202, with a webbing 232 interconnecting an inner periphery of the flange 231 and an outer periphery of the center section 230. As shown in FIG. 9, the spray face 203 includes a plurality of inner channels 233 that are configured to cooperate with outer channels 253 of the control ring 205 to define nozzle cavities for receiving the nozzles 262 therein. Each inner channel 233 is located generally at the inner periphery of the webbing 232/flange 231 and each inner channel 233 defines at least a portion of one nozzle cavity. As shown in FIG. 8, the spray face 203 includes a plurality of apertures 234 aligned circumferentially in and extending through the center section 230 of the spray face 203. As shown in FIG. 9, each aperture 234 receives one nozzle 262 and, therefore, each aperture 234 cooperates with one inner channel 233 of the spray face 203 and one outer channel 253 of the control ring (discussed below) to define the orientation of the nozzle 262 through the orientation of the nozzle cavity. Each pair of adjacent inner channels 233 can be separated by a projection (e.g., similar to or the same as the projection 135) and an adjacent wall (e.g. similar to or the same as the wall 136), and the projection can engage an associated inner channel 233 in the control ring 205 to couple the spray face 203 and the control ring 205 while preventing relative rotation between them. An advantage of having the spray face 203 as the outer most part is the aesthetics of the spray face 203 can be tailored to provide different aesthetics of the sprayer 200. By way of example, the spray face 203 can be chromed, can include bushed stainless steel, or can include other desired surface finishes.

Also shown in FIGS. 8 and 9, the control ring 205 includes an annular body 250 having an inner periphery 251 and an outer periphery 252. The outer periphery 252 includes a plurality of outer channels 253 disposed therein, with each outer channel 253 extending longitudinally and configured to cooperate with one channel 233 of the spray face 203 to define part of one nozzle cavity. The outer periphery 252 also includes a plurality of projections 255 extending both longitudinally and radially outward, with the projections 255 and outer channels 253 in alternating order. Walls can be provided adjacent to (e.g., between) each set of projection 255 and channel 253. As shown in FIG. 9, the thickness of the control ring 205 is substantially the same as the offset from the center section 230 to the flange 231 of the spray face 203 so that when the control ring 205 is coupled to the spray face 203, an interior surface of the control ring 205 is substantially flush with an interior surface of the flange 231 of the spray face 203. This arrangement advantageously supports the base 260 of the nozzle assembly 206, which is generally flat (e.g., planar), and improves the seal of the fluid chamber 204 (e.g., between the spray face 203 and the outer periphery 268 of the base 260).

The control ring 205 is assembled between the spray face 203 and the nozzle assembly 206, with the outer channels 253 of the control ring 205 cooperating with (e.g., facing, engaging, etc.) the inner channels 233 of the spray face 203, as shown in FIG. 9. Then the coupled nozzle assembly 206, control ring 205, and spray face 203 are assembled to the spray head 102, with the spray face 203 coupling to the spray head 102. The nozzle assembly 206 is disposed between the spray head 102 and the control ring 205. The nozzle assembly 206 defines at least part of the internal fluid chamber 204 of the sprayer 200. Water enters the fluid chamber 204 through the fluid connection between the spray head 102 and the base 101. The water then flows through the plurality of nozzles 262 to form a spray pattern having a plurality of fluid streams, with each fluid stream being emitted from one nozzle 262. The direction of each fluid stream is controlled by the orientation (e.g., alignment) of the associated nozzle 262, which is controlled by the orientation of the associated nozzle cavity. The orientation of each nozzle cavity is controlled by the inner channel 233 of the spray face 203, the outer channel 253 of the control ring 205, and the aperture 234 in the spray face 203. This orientation is designed to direct a fluid stream from the nozzle 262 along a predetermined spray trajectory (e.g., along a compound axis) with a higher degree of precision, while capable of being manufactured using lower cost and lower complex methods.

Figure 10:
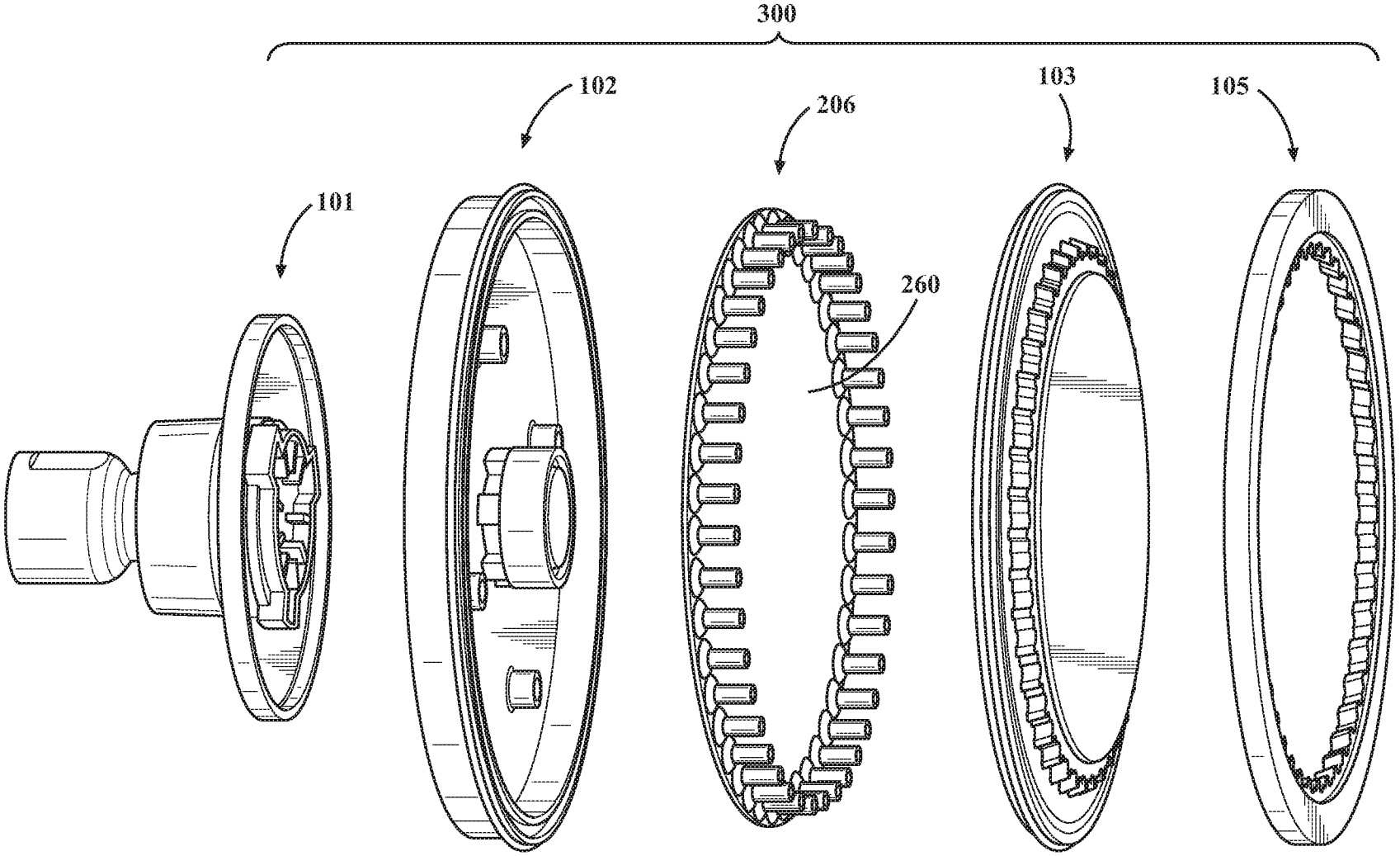
FIG. 10 is an exploded perspective view of an exemplary embodiment of a sprayer, according to this application.

FIG. 10 illustrates an exemplary embodiment of a sprayer 300 that is similar to the sprayer 100. The illustrated sprayer 300 includes basically the same base 101, the same spray head 102, the same spray face 103, and the same control ring 105 as those elements of the sprayer 100. However, the sprayer 300 differs from the sprayer 100 in that the sprayer 300 includes the nozzle assembly 206 of the sprayer 200 rather than the nozzle assembly 106 of the sprayer 100. The nozzle assembly 206 is located between the spray head 102 and the spray face 103 with the base 260 of the nozzle assembly 206 either located within the internal fluid chamber or defining at least part of the fluid chamber, and with the distal end of the nozzles 262 extending within and/or beyond the nozzle cavities formed between complementary outer and inner channels of the spray face 103 and control ring 105, respectively.

Also shown in FIG. 10, the control ring 105 is assembled to the outside of the spray face 103 (with the inner channels mating with the outer channels) either before or after the nozzles of the nozzle assembly 206 are inserted into their associated nozzle cavities until the base 260 of the nozzle assembly 206 is proximate to (e.g., abutting) an inner surface of the spray face 103. Then, the coupled nozzle assembly 206, spray face 103, and control ring 105 are assembled to the spray head 102 and base 101, with the spray face 103 coupling to the spray head 102. Thus, the nozzle assembly 206 is disposed between the spray head 102 and the spray face 103, and the nozzle assembly 206 defines at least part of the internal fluid chamber in the sprayer 300. Water enters the fluid chamber from the base 101 and spray head 102, then water exits the sprayer 300 through the plurality of nozzles to form a spray pattern having a plurality of fluid streams, where each fluid stream is emitted from one nozzle. The direction of each fluid stream is controlled by the orientation (e.g., alignment) of the associated nozzle, which is controlled by the orientation of the associated nozzle cavity. The orientation of each nozzle cavity is controlled by one outer channel of the spray face 103, one inner channel of the control ring 105, and one aperture in the spray face 103. This orientation is designed to direct the associated fluid stream from the nozzle along a predetermined spray trajectory (e.g., along a compound axis or compound angle) with a higher degree of precision, while capable of being manufactured using lower cost and lower complex methods. By way of example, the compound angle of the nozzle can include a first angle relative to an x-axis (horizontal axis) and a second angle relative to a y-axis (vertical axis) in a plan view (e.g., planar on the mat or base 160 of the nozzle assembly 106). Also, for example, the first angle and/or the second angle can be oblique angles, such as to converge the fluid streams from the nozzles. This is particular advantageous for spray patterns having a plurality of converging fluid streams (both converging with and without intersection), since variations of one or more fluid streams in converging spray patterns are more noticeable than fluid stream variations in diverging spray patterns.

Figure 13:
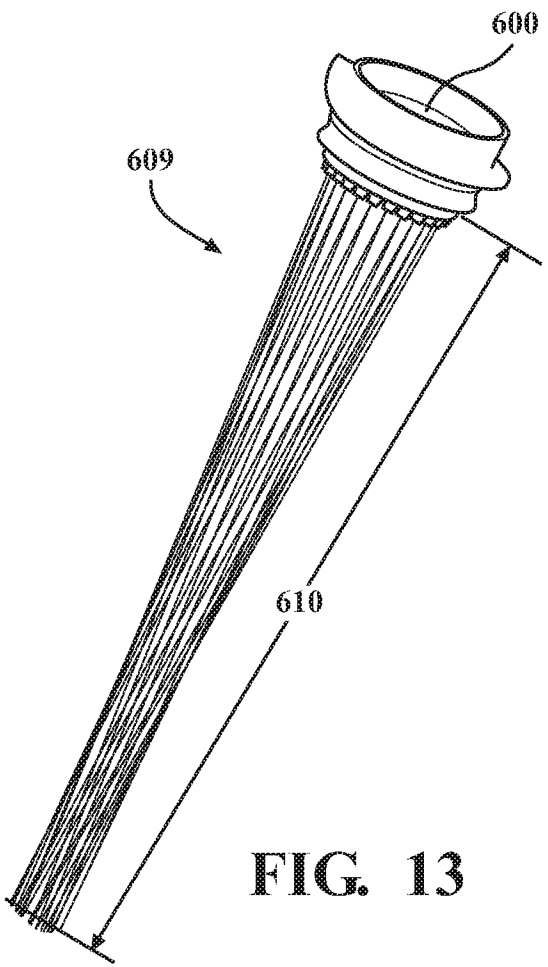
FIG. 13 is a perspective view of a sprayer, according to this application, emitting water in a fan spray pattern.
Figure 12:
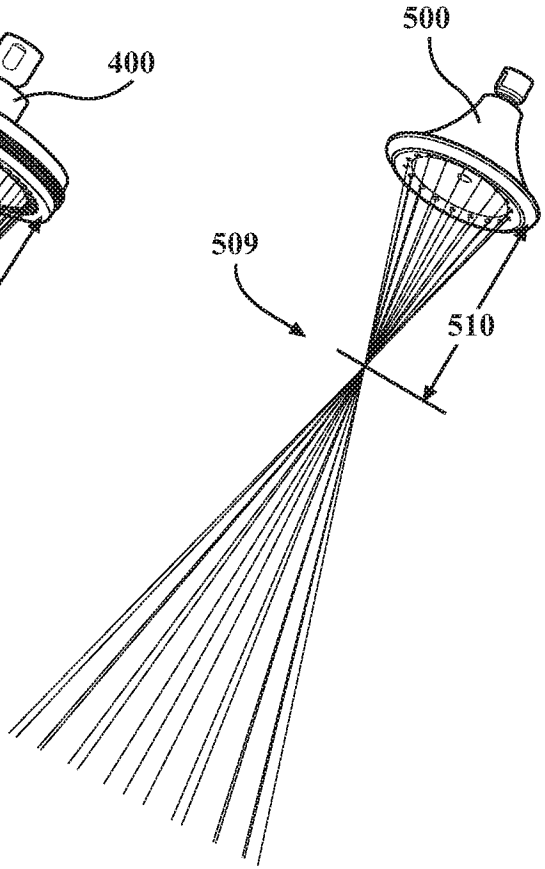
FIG. 12 is a perspective view of a sprayer, according to this application, emitting water in a conical spray pattern.
Figure 11:
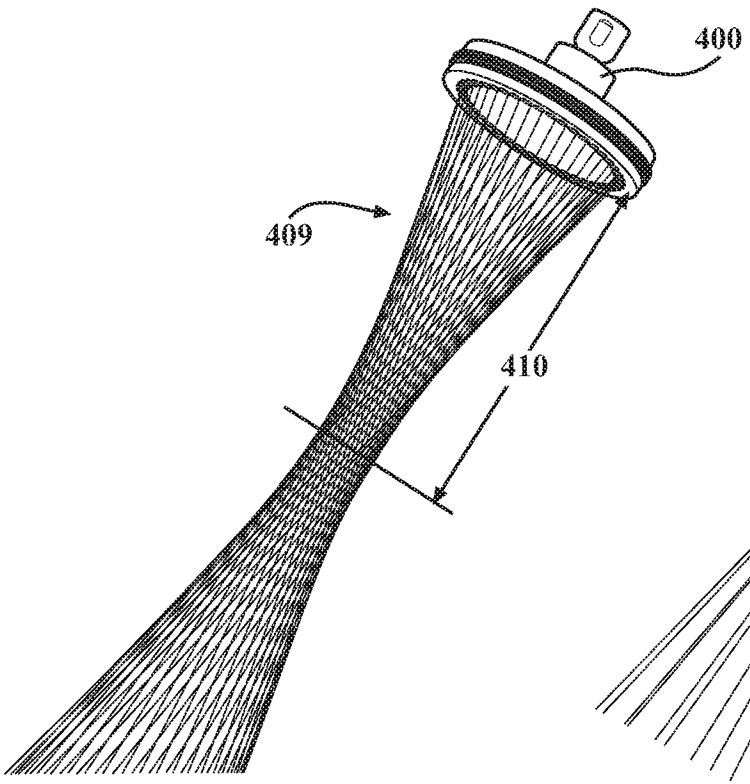
FIG. 11 is a perspective view of a sprayer, according to this application, emitting water in a hyperboloidal spray pattern.

By way of example only, FIGS. 11-13 illustrate several exemplary embodiments of converging spray patterns, which the sprayers 100, 200, 300 of this application can be configured to emit. FIG. 11 illustrates a sprayer 400 that emits a spray pattern 409 having a hyperbolic shape that is configured to converge without intersecting. That is the fluid streams forming the hyperbolic shaped spray pattern 409 converge from the sprayer 400 to a focal distance 410 without intersecting or colliding, then the fluid streams diverge beyond the focal distance 410 without intersecting or colliding. FIG. 12 illustrates a sprayer 500 that emits a spray pattern 509 having a conical shape that is configured to converge and intersect (e.g., collide). The fluid streams forming the spray pattern 509 converge from the sprayer 500 to a focal distance 510 where the streams are configured to intersect/collide. Beyond the focal distance 510, the fluid streams of the spray pattern 509 (if moving along their original vectors) would diverge in a conical shape. However, depending on the severity of the collisions, the fluid streams may not follow the original flow paths. FIG. 13 illustrates a sprayer 600 that emits a spray pattern 609 having a fan shape, a wedge shape, or similar shape, which converges without intersecting. Thus, the sprayers 100, 200, 300 can be configured to provide one or more of the spray patterns 409, 509, 609, as well as other types of spray patterns.

The sprayers disclosed herein provide relatively higher accuracy fluid streams from the nozzles, which results in an actual spray pattern that more closely resembles the desired/predicted shape of the spray pattern. The more precise fluid streams are achieved by controlling the shape of the nozzles through a control ring and a spray face, each of which defines part of each nozzle cavity. Further, the accuracy/precision can be provided utilizing less expensive and less complicated manufacturing methods/techniques since the control ring and the spray face are separate elements/components. Further, the flexibility of the nozzles (compared to the control ring and spray face, which are more rigid) allows each nozzle to have a configuration (e.g., shape, alignment, etc.) after assembly of the sprayer that is different than the configuration of the nozzle relative to the base of the nozzle assembly (i.e., the nozzle assembly alone prior to assembly of the sprayer).

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements of the sprayers as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

Other substitutions, modifications, changes and omissions may also be made in the design, operating conditions and arrangement of the various exemplary embodiments without departing from the scope of the present invention. For example, any element (e.g., base, spray head, spray face, control ring, nozzle assembly, etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A sprayer comprising:

a spray head configured to receive water;

a spray face coupled to the spray head and defining an internal fluid chamber, which is located between the spray face and the spray head and is fluidly connected with the spray head, wherein the spray face comprises a plurality of channels and a plurality of apertures;

a control ring comprising a plurality of channels, wherein the control ring is coupled to the spray face so that each channel of the control ring cooperates with one associated channel and one associated aperture of the spray face to define a nozzle cavity; and a nozzle assembly comprising a mat and a plurality of nozzles coupled to the mat, wherein each nozzle of the plurality of nozzles is disposed in one associated nozzle cavity to control an orientation of the nozzle.

2. The sprayer of claim 1, wherein the spray face is disposed between the control ring and the spray head.

3. The sprayer of claim 2, wherein an inner surface of the nozzle assembly is adjacent to an outer surface of the control ring and an outer surface of a center section of the spray face so that an outer surface of the nozzle assembly is an exterior aesthetic surface, and wherein each nozzle extends from the inner surface of the nozzle assembly toward the internal fluid chamber.

4. The sprayer of claim 2, wherein the plurality of channels of the control ring are disposed around an inner periphery of the control ring, the plurality of channels of the spray face are disposed around an outer periphery of the spray face, such that each channel of the control ring and the associated channel of the spray face define an outlet portion of the nozzle cavity, and the associated aperture defines an inlet portion of the nozzle cavity.

5. The sprayer of claim 4, wherein the spray face comprises:

a circular center section having the outer periphery;

an annular flange offset from the center section toward the spray head and extending radially outward beyond the outer periphery of the center section, the flange forming a seal of the internal fluid chamber with the spray head;

wherein each aperture of the plurality of apertures of the spray face is in the flange and each aperture is generally aligned with one channel of the plurality of channels of the spray face.

6. The sprayer of claim 4, wherein each channel of the plurality of channels of the control ring is semi-cylindrical, each channel of the plurality of channels of the spray face is semi-cylindrical, and each semi-cylindrical channel of the control ring forms a cylindrical portion of the nozzle cavity with the associated semi-cylindrical channel of the spray face.

7. The sprayer of claim 1, wherein the nozzle assembly is disposed within the spray head and the spray face, and the nozzle assembly defines at least part of the internal fluid chamber.

8. The sprayer of claim 7, wherein the control ring is disposed between the spray face and the spray head, the plurality of channels of the control ring are disposed around an outer periphery of the control ring, and the plurality of channels of the spray face are disposed around an inner periphery of the spray face.

9. The sprayer of claim 8, wherein the spray face comprises a center section and a flange that is offset from the center section toward the spray head, the inner periphery is along an inside of the flange, and the control ring is adjacent to the center section longitudinally and is radially inward from the inner periphery of the flange.

10. The sprayer of claim 9, wherein an outer periphery of the mat forms a seal with the spray head and the spray face, and an inner part of the mat, which is located radially inward from the outer periphery of the mat, forms a seal with the control ring.

11. The sprayer of claim 7, wherein at least a portion of the spray face is disposed between the control ring and the nozzle assembly, the plurality of channels of the control ring are disposed around an inner periphery of the control ring, and the plurality of channels of the spray face are disposed around an outer periphery of the spray face.

12. The sprayer of claim 11, wherein the spray face comprises a center section and a flange, which is offset from the center section toward the spray head and is disposed between the control ring and the nozzle assembly, and wherein the plurality of apertures are circumferentially aligned and extend through the flange.

13. The sprayer of claim 12, wherein the mat is flexible and seals with the spray face around each aperture of the plurality of apertures, the orientation of at least one nozzle of the plurality of nozzles is perpendicular to the mat prior to assembly of the sprayer, and the orientation of the at least one nozzle is at a compound angle relative to the mat after assembly of the sprayer.

14. A sprayer comprising:

a spray head having a base, a wall extending from the base, and a water inlet;

a spray face coupled to the spray head forming an internal fluid chamber, which is located between the spray face and the spray head and is fluidly connected to the water inlet, wherein the spray face comprises a plurality of channels and a plurality of apertures;

an annular control ring coupled to the spray face and comprising a plurality of channels along an inner periphery, wherein each channel of the control ring cooperates with one associated channel and one associated aperture of the spray face to define a nozzle cavity; and a nozzle assembly comprising a flexible mat and a plurality of nozzles coupled to the mat, wherein each nozzle is disposed in one associated nozzle cavity having an assembled orientation relative to the mat and is fluidly connected to the internal fluid chamber.

15. The sprayer of claim 14, wherein the assembled orientation includes a compound angle that includes a first angle relative to a first axis and a second angle relative to a second axis in a plan view of the mat.

16. The sprayer of claim 15, wherein each nozzle has an unassembled orientation prior to the nozzle being disposed in the nozzle cavity, and the unassembled orientation is different than the assembled orientation.

17. The sprayer of claim 16, wherein each nozzle is substantially perpendicular to the mat in the unassembled orientation, each of the first and second angles is an oblique angle in the assembled orientation, and each oblique angle is defined in part by the spray face and in part by the control ring.

18. A sprayer comprising:

a spray head having a base, a wall extending from the base, and a water inlet;

a spray face coupled to the spray head forming an internal chamber located between the spray face and the spray head, wherein the spray face comprises a plurality of channels;

a control ring coupled to the spray face and disposed in the internal chamber, the control ring comprising a plurality of channels along a periphery, wherein each channel of the control ring cooperates with one associated channel of the spray face to define a nozzle cavity; and a nozzle assembly comprising a flexible mat and a plurality of nozzles coupled to the mat, wherein each nozzle extends into one associated nozzle cavity and is fluidly connected to the water inlet.

19. The sprayer of claim 18, wherein the flexible mat is disposed within the internal chamber and divides the internal chamber into a first portion, which is fluidly connected to the water inlet, and a second portion, in which the control ring is disposed; wherein each nozzle is coupled to the flexible mat through a web, which is in an associated recess defined by the control ring and the spray face; and wherein a portion of the flexible mat seals with a portion of at least one of the spray head and the spray face to fluidly separate the first portion from the second portion of the internal chamber.

20. The sprayer of claim 18, wherein the spray face comprises a plurality of apertures, each aperture of the plurality of apertures is associated with and cooperates with one associated channel from each of the spray face and the control ring to define one associated nozzle cavity, and each nozzle is fluidly connected to at least a portion of the internal chamber.

* * * * *